US010407145B2

(12) United States Patent
Miller

(10) Patent No.: US 10,407,145 B2
(45) Date of Patent: Sep. 10, 2019

(54) HANDHELD UNDERWATER BREATHING APPARATUS

(71) Applicant: Austin Jeffrey Miller, Phoenix, AZ (US)

(72) Inventor: Austin Jeffrey Miller, Phoenix, AZ (US)

( * ) Notice: Subject to any disclaimer, the term of this patent is extended or adjusted under 35 U.S.C. 154(b) by 307 days.

(21) Appl. No.: 15/368,680

(22) Filed: Dec. 5, 2016

(65) Prior Publication Data

US 2018/0154992 A1 Jun. 7, 2018

(51) Int. Cl.
*B63C 11/22* (2006.01)

(52) U.S. Cl.
CPC ..... *B63C 11/22* (2013.01)

(58) Field of Classification Search
CPC ..... B63C 11/22; B63C 11/18; B63C 11/205
See application file for complete search history.

(56) References Cited

U.S. PATENT DOCUMENTS

| | | | | |
|---|---|---|---|---|
| 3,656,196 | A * | 4/1972 | O'Neill | B63C 11/30 128/205.13 |
| 5,092,327 | A * | 3/1992 | Tragatschnig | B63C 11/20 128/201.27 |
| 5,299,567 | A * | 4/1994 | Joye | B63C 11/24 128/204.26 |
| 9,220,854 | B1 | 12/2015 | Okrusko | |
| 9,815,535 | B2 * | 11/2017 | de Rivero | A62B 7/12 |
| 2002/0148467 | A1 | 10/2002 | Bosse et al. | |
| 2003/0168061 | A1 * | 9/2003 | Hart | B63C 11/22 128/201.27 |
| 2011/0041852 | A1 * | 2/2011 | Bergman | A61M 16/0078 128/205.13 |

* cited by examiner

*Primary Examiner* — Kristen Matter

(57) ABSTRACT

An underwater breathing apparatus includes an elastic interior bag designed to hold air. The interior bag is contained within an outer container, which is designed to hold a weighted material which functions to offset positive buoyancy created by the air in the interior bag. The elasticity of the interior bag, as well as a slider mechanism, functions to provide pressure such that the air is accessible to a human diver while underwater. The apparatus also contains a pump that is used to fill the interior bag with air, and a mouthpiece that functions to allow the user to draw air from the apparatus.

6 Claims, 6 Drawing Sheets

HANDHELD UNDERWATER BREATHING APPARATUS

BACKGROUND OF INVENTION

Underwater diving is one of the most popular recreational activities in the world. One of the most significant limitations to this pursuit, however, is the limited amount of air a diver can hold in his lungs. For centuries, humans have attempted to develop ways to increase the amount of time they can spend underwater by allowing themselves to take in fresh air while underwater. Diving bells were used to provide an underwater breathing space for divers. Later, hoses supplied air from the surface to helmets worn by divers as they were submerged below. One of the most significant advancements came with the development of SCUBA systems, which allowed for self-contained breathing systems to be used by divers looking for a more autonomous diving experience. However, such devices are often cumbersome and impractical for casual swimming or diving. Modern SCUBA systems require special certification to operate, are expensive, and cannot be used in many recreational settings.

One solution to this problem has been to use a simple container to store air that can be breathed in by an underwater diver. However, one major problem that occurs when air is submerged underwater is that the resulting positive buoyancy inhibits the diver's ability to reach any appreciable depth. Other prior art has attempted to combat this buoyancy issue by adding weight to the apparatus. However, this added weight creates another issue with buoyancy. After air is consumed and the positive buoyancy of the human-apparatus system is reduced, the extra weight of the apparatus works to inhibit the diver's ability to return to the surface. The only way to prevent such an outcome is to exhale back into the container, thus maintaining the buoyancy of the system. However, doing so creates a dangerous scenario in which the diver is breathing in air too rich in carbon dioxide, which can cause hypercapnia and related problems.

Some devices in the prior art are directed towards emergency air bladders that provide a user with air drawn from a bladder. However, these devices do not correct for the positive buoyancy created by the air contained within the device. Thus, the devices are unable to be confidently controlled by a user while submerged. Also, they do not provide for repeated inflation by a means integrated into the device.

The immediate invention solves many of the problems associated with the prior art by providing a breathing system that compensates for positive buoyancy and eliminates heavy costs, complexities, and formalities of previous autonomous systems. The adjustable nature of the weight compensation system allows for more accurate buoyancy compensation, enabling a diver to move with maximum efficiency in the water. Also, having the buoyancy compensation element integrated into the apparatus allows for better control of the apparatus, as opposed to an alternative weight system that is separate from the air source, such as a weighted belt. The immediate invention also does not employ a pressurized air tank or regulator, hallmarks of SCUBA equipment that require special certification to use. This lack of necessary certification allows casual divers to enjoy enhanced underwater exploration without the effort and expense associated with such certification.

SUMMARY OF THE INVENTION

In various representative aspects, the present invention includes an elastic interior bag that is enclosed in an outer container. The apparatus is designed for use underwater by a diver. The bag has the ability to hold air, supplied by an integrated pump, and the container has the ability to hold a weighted material. Attached to the bag is a mouthpiece with a valve that allows the user to draw air from the bag without water being drawn into the bag. The unique design of the apparatus allows for submersion of an air source underwater while compensating for the positive buoyancy created by said air. The elasticity of the bag makes it easier to draw air from the apparatus in light of the pressure on the diver from the underwater environment. The apparatus also includes a slider mechanism that allows the user to push air out of the bag using manual force to aid in overcoming the pressure on the submerged user's lungs.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements throughout the figures.

Figure 1:
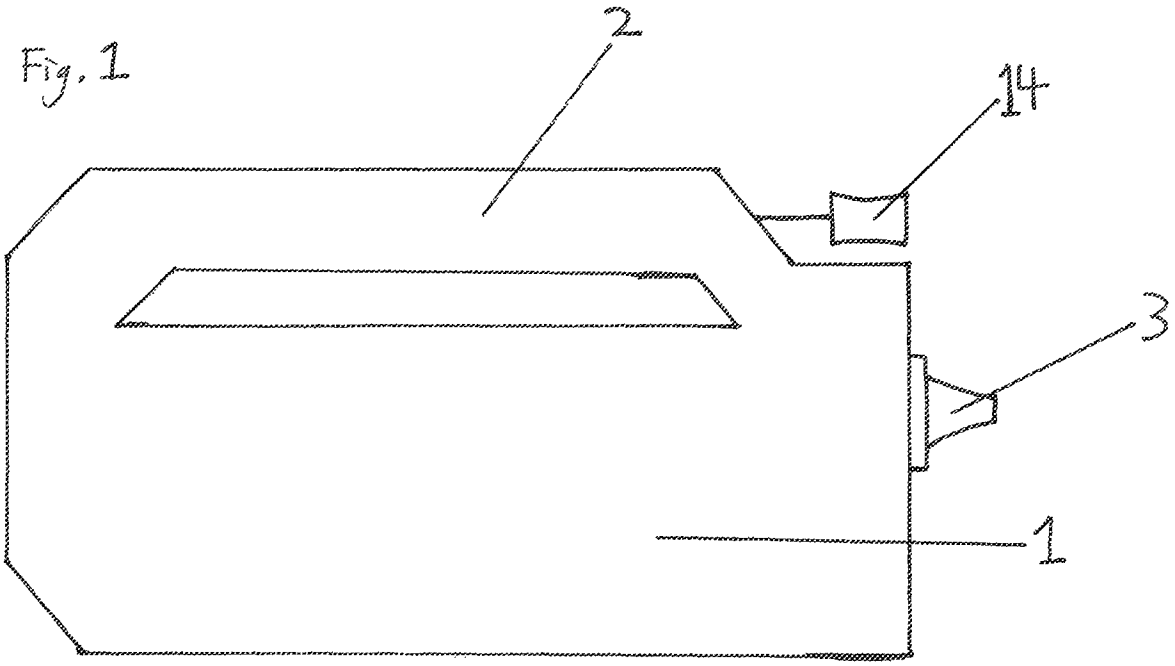
FIG. 1 representatively illustrates a side view of the apparatus, with the handle portion oriented at the top of the figure and the mouthpiece oriented at the right of the figure.
Figure 2:
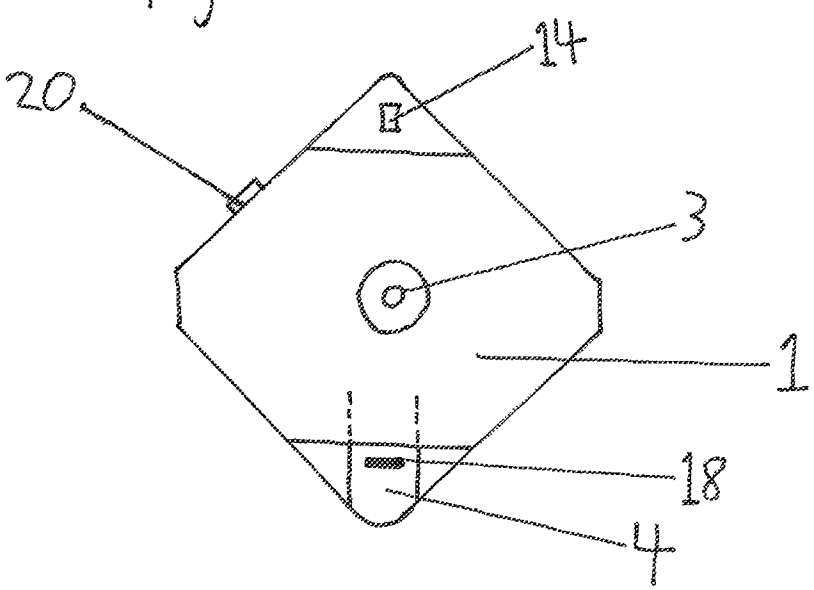
FIG. 2 representatively illustrates a front view of the apparatus, with the pump pull tab oriented at the top of the figure, the mouthpiece oriented at the center of the figure, and the compartment door oriented at the bottom of the figure.
Figure 3:
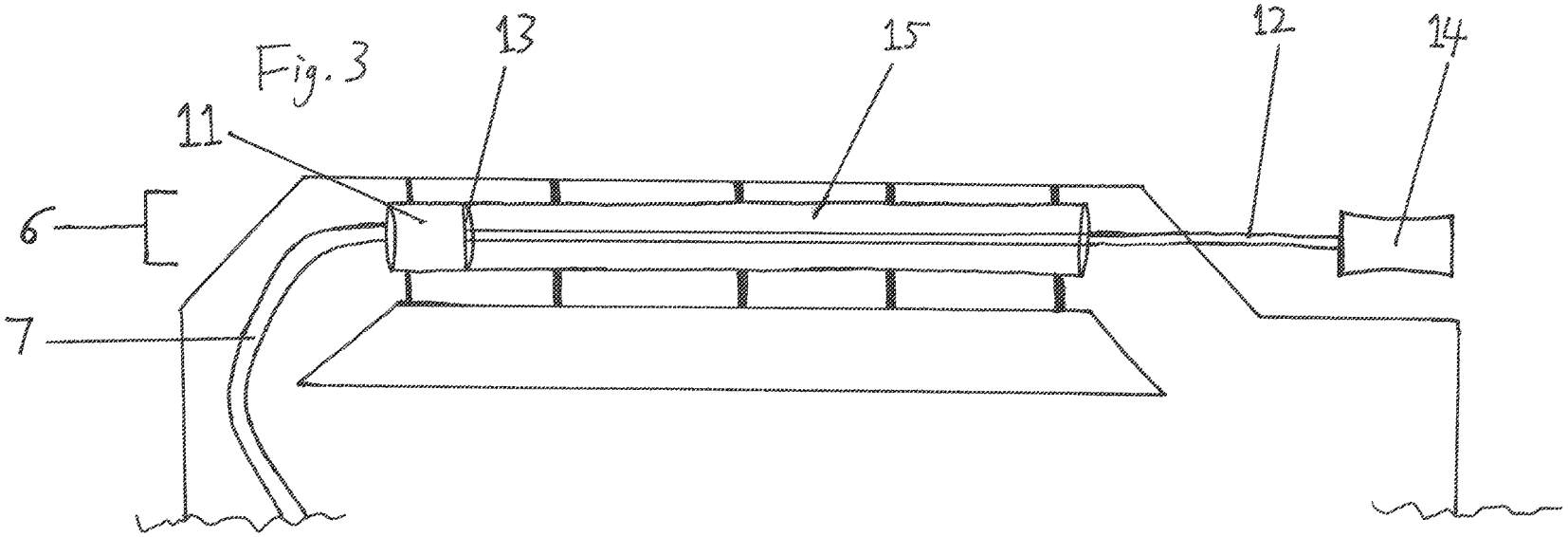
FIG. 3 representatively illustrates a cross-sectional side view of the top portion of the apparatus, with the integrated pump visible within the handle portion.
Figure 4:
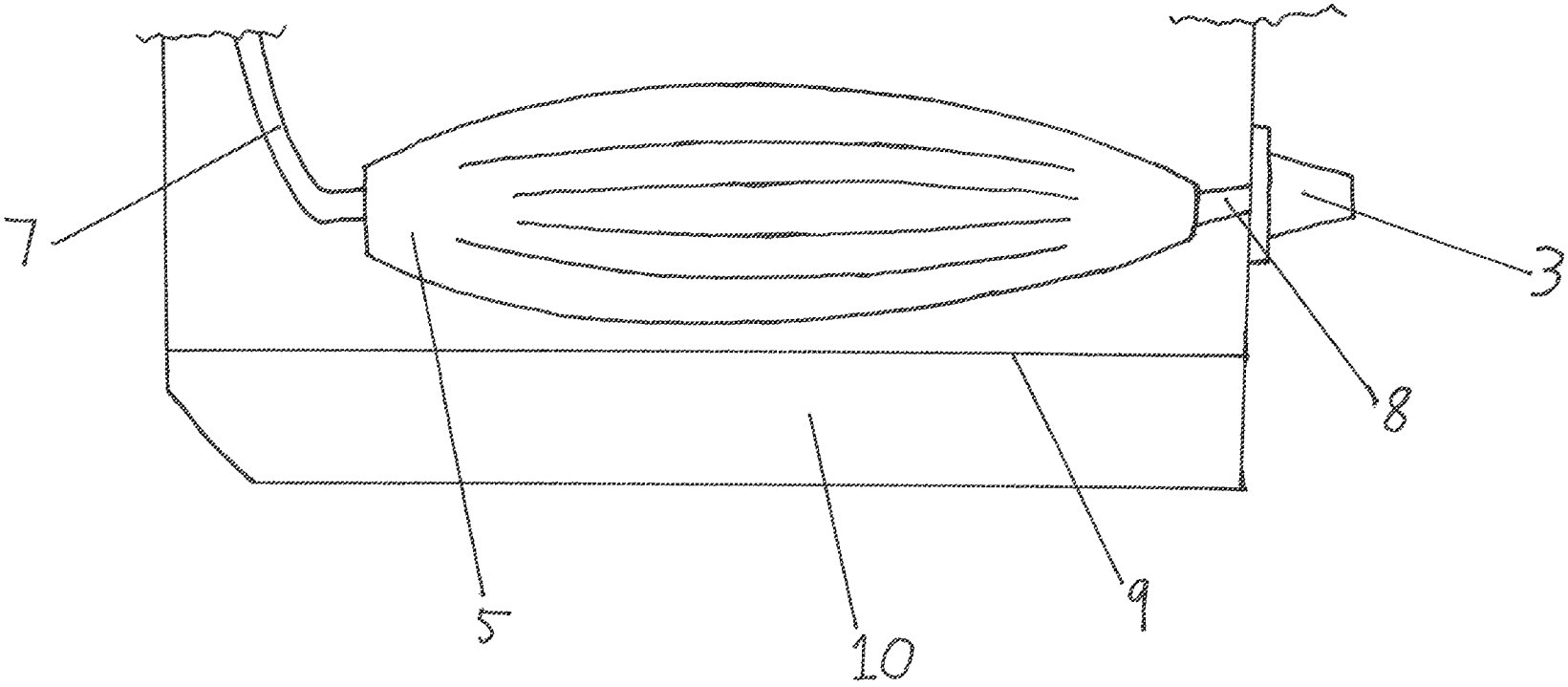
FIG. 4 representatively illustrates a cross-sectional side view of the bottom portion of the apparatus, with the inflatable bag visible within the body of the first compartment of the apparatus, in a deflated position.
Figure 5:
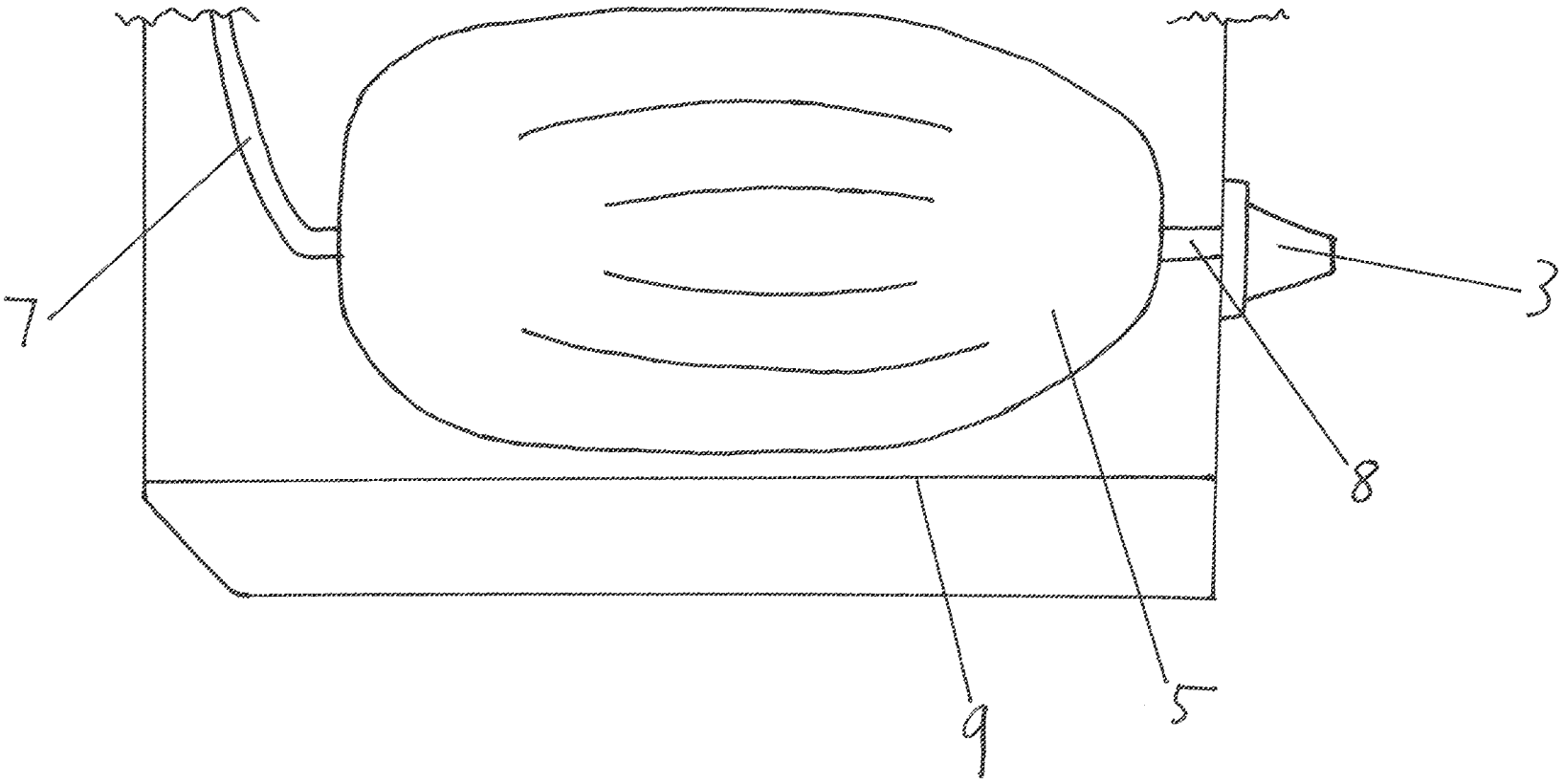
FIG. 5 representatively illustrates a cross-sectional side view of the bottom portion of the apparatus, with the inflatable bag visible within the body of the first compartment of the apparatus, in an inflated position.
Figure 6:
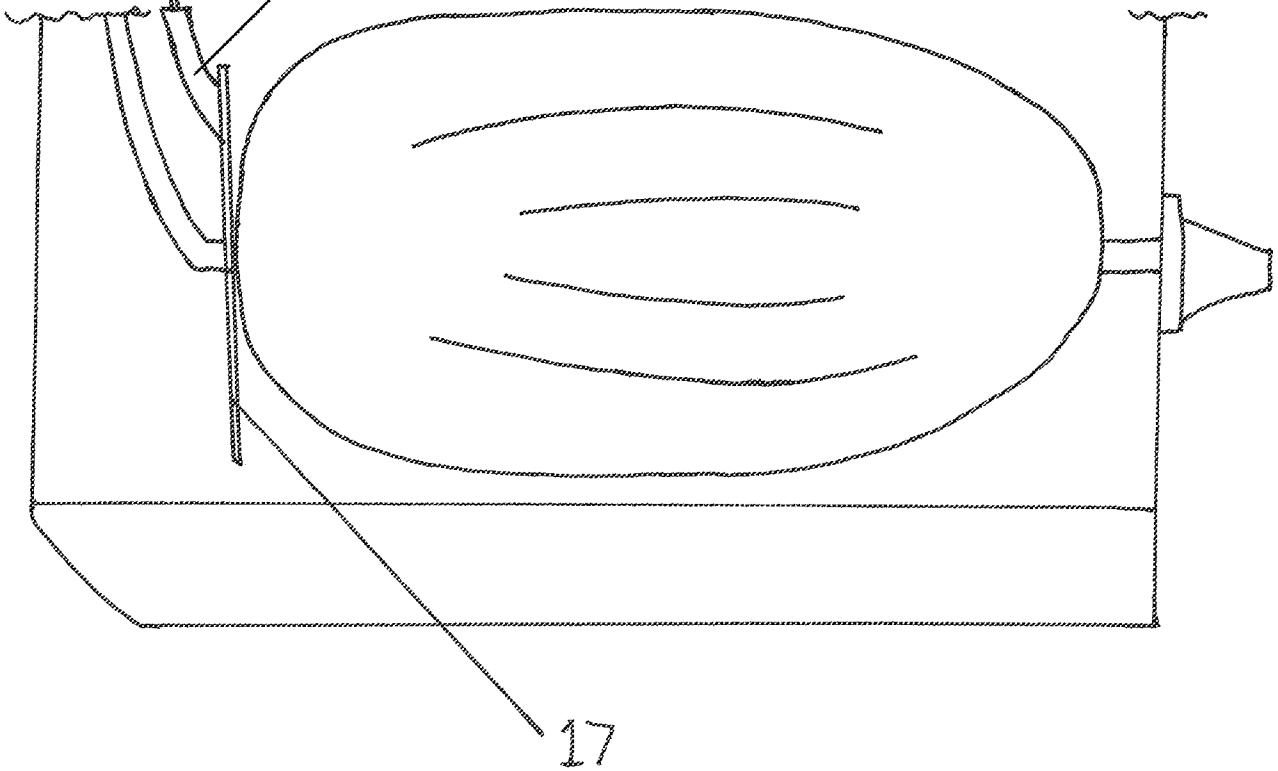
FIG. 6 representatively illustrates a cross-sectional side view of the apparatus, with the sliding mechanism visible and located between the pump hose and the interior bag.

DESCRIPTION OF NUMERALS USED IN THE FIGS.

1. Outer container wall
2. Handle portion
3. Mouthpiece
4. Compartment door
5. Interior bag
6. Integrated pump
7. Pump hose
8. Mouthpiece hose
9. Compartment divider
10. Weighted material
11. Plunger portion
12. Rod
13. Stopper
14. Plunger pull tab
15. Chamber portion
16. Connector portion
17. Disk portion
18. Compartment door pull tab
19. Slider mechanism tab
20. Track portion

DETAILED DESCRIPTION OF EXEMPLARY EMBODIMENTS

Structure

Outer Container

The outer container (1) functions to hold the components of the apparatus. It encloses the interior bag (5) and also contains the mouthpiece (3) and the sliding mechanism. The outer container also secures the integrated pump (6), as well as a handle (2) that is used to hold the apparatus. The outer container is separated into two compartments by way of a compartment divider (9). The first compartment is oriented on top of the second compartment, and houses the interior bag and its accompanying components. The second compartment houses the weighted material (10) used for buoyancy control.

In the preferred embodiment, the outer container is rigid in design and forms a hard, cuboid-shaped exterior of the apparatus. The handle is integrated into the form of the outer container such that it comprises one of the corners of the cuboid shape of the apparatus.

Any number of suitable materials may be used for the construction of the outer container. In the preferred embodiment, the outer container is constructed from high durability plastic. Other embodiments may include lightweight metals such as aluminum. Other embodiments may employ a heavier metal, such as iron, which itself aids in offsetting the positive buoyancy of the inflated apparatus.

The handle functions to allow the user to carry the apparatus while above or below water. In the preferred embodiment, the handle runs along some length of the unit so as to provide enough space for a hand to comfortably grip. There is also enough space between the handle portion and the body of the apparatus so as to allow a hand to freely move while grasping and manipulating the apparatus. In the preferred embodiment, the handle contains within it an integrated pump.

The integrated pump functions to fill the interior bag with fresh air. Any suitable pump that may be integrated into the apparatus may be used for this function. In the preferred embodiment, the pump is contained within the integrated handle. The pump comprises a plunger portion (11), a chamber portion (15), and a pump hose (7).

The chamber portion of the pump is cylindrical and is affixed to the interior walls of the handle, and contains a small hole at each end. In the preferred embodiment, the circumference of the pump chamber portion is marginally smaller than the width of the handle such that the chamber portion fills most of the available space within the handle.

The plunger portion comprises a stopper (13), rod (12), and pull tab (14). The stopper is cylindrical, with rubber lining that is contained within the receiving portion of the cylinder. A first end of the rod is attached to the stopper and travels through a first hole in the receiving cylinder. A second end of the rod attaches to the pull tab. The rod may be constructed from any suitable material. In the preferred embodiment, the rod is constructed from durable plastic. Other embodiments may utilize other materials such as metal.

In the preferred embodiment, the pull tab is ergonomically shaped such that it may be gripped easily by human fingers, and remains exterior to the cylindrical receiving portion at all times. In the preferred embodiment, the pull tab also comprises a textured surface to aid with grip. The pull tab may be constructed from any suitable material. In the preferred embodiment, the pull tab is constructed from durable plastic. Other embodiments may utilize other materials such as metal, or may employ a pull tab that is capable of being hidden within the handle portion.

The hose of the pump is connected to a second hole of the receiving portion, which is opposite the first hole. The hose then travels through the remaining hollow portion of the handle, and into the main body of the outer container, where it connects to a port on the interior bag. The hose may be made of any suitable material. In the preferred embodiment, the hose is constructed from durable rubber. Other embodiments may employ synthetic material such as plastic.

The outer container also holds within it a weighted material that allows for buoyancy compensation to offset the positive buoyancy created by the air in the interior bag. The weighted material may be any material suitable for adding weight to the apparatus. In the preferred embodiment, the second compartment of the outer container has an opening that allows the user to fill the second compartment with sand. The opening comprises a compartment door (4) that has a compartment door pull tab (18) that allows the door to be opened and closed. Other embodiments may utilize other mechanisms suitable for revealing an opening to the second compartment.

The sand functions as the weighted material that compensates for buoyancy. Other embodiments may employ materials such as metal weights or stones. Other embodiments may also include other methods of adding weight to the apparatus, such as affixing a weighted material, such as metal weights, to the exterior of the outer container.

In the preferred embodiment, the outer container also comprises a slider mechanism that functions to force air out of the interior bag. The slider mechanism comprises a disk portion (17), a connector portion (16), a slider mechanism tab (19), and a track portion (20). The disk portion is positioned anterior to the interior bag, within the outer container, on the end of the apparatus opposite the mouthpiece. The disk portion is affixed to the interior bag and the pump hose such that it forms a link between the pump hose and the interior bag. The pump hose enters the interior bag through the center of the disk portion. The connector portion is affixed to an edge of the disk portion at its first end, and extends to the exterior of the outer container, where its second end is affixed to the tab portion. A narrow, straight track portion (20) runs along a length of the outer container such that the slider mechanism may travel up and down the unit, allowing the user to slide the tab and force air out of the interior bag. The connector portion is shaped such that it is in contact with the edges of the track portion, thus holding the disk portion steady as manual force is applied to the tab portion.

The tab portion may be shaped in any way that makes it suitable for applying manual force and driving the disk portion forward. In the preferred embodiment, the tab portion is a single piece extending outward from the apparatus, and slightly curved in order to make it easier for the user to apply manual force. It is approximately one inch in length. Other embodiments may be longer or shorter. Other embodiments may employ other shapes, such as straight, un-curved tabs, or circular tabs that a user inserts a finger or fingers into. The slider mechanism may be made from any suitable material. In the preferred embodiment, the slider mechanism is made from durable plastic. Other embodiments may employ metal such as aluminum, or a combination of metal and plastic for the separate components of the slider mechanism.

Interior Bag

The interior bag functions to store air that is subsequently inhaled by the user. The interior bag is located within the first compartment of the outer container. In the preferred embodiment, the interior bag is held in place by virtue of its connections with the pump hose and the mouthpiece. The interior bag may be constructed from any material that is suitable for holding air and providing high elasticity. In the preferred embodiment, the interior bag is constructed from durable rubber which allows for repeated inflation and deflation. The rubber has a high elasticity such as to create pressure for the air to be easily breathed in while the user is submerged in a high pressure underwater environment. Other embodiments may employ synthetic materials exhibiting similar qualities.

The mouthpiece functions to selectively deliver air from the interior bag to the user. In the preferred embodiment, the mouthpiece is connected to the interior bag by way of a mouthpiece hose (8) contained fully within the outer container. The mouthpiece hose runs between ports on both the interior bag and the mouthpiece. In other embodiments, the interior bag may be directly connected to the mouthpiece without the use of a hose.

The mouthpiece then traverses the outer container, which it is connected to. The mouthpiece extends outwards from the outer container, making it accessible to the user. The mouthpiece comprises an outward-oriented cylindrical opening that the user draws air from. In the preferred embodiment, the mouthpiece connects to a one-way type valve that allows air to be drawn from the interior bag, but does not allow fluids such as water or air to flow into the interior bag from outside the apparatus. Any style of valve that is suitable for allowing air to be drawn while preventing flow into the interior bag may be used. For example, a bite valve that allows the user to open the valve by way of applying mechanical force may be used.

In the preferred embodiment, the mouthpiece is integrated into the outer container such that the mouthpiece is a part of the outer container. However, other embodiments may utilize a mouthpiece that is removable from the apparatus.

Closing

In the foregoing specification, the invention has been described with reference to specific exemplary and preferred embodiments. Various modifications and alterations may be made, however, without departing from the scope of the present invention as set forth in the claims. The specification and figures are illustrative, not restrictive, and modifications are intended to be included within the scope of the present invention. Accordingly, the scope of the invention should be determined by the claims and their legal equivalents rather than by only the embodiments described in the foregoing specification.

For example, the components recited in the claims may be assembled or otherwise operationally configured in a variety of ways and are accordingly not limited to the specific configuration recited in the claims.

Benefits, advantages, and solutions to problems have been described above with regard to specific embodiments. Any benefit, advantage, solution, or any element that may cause any particular benefit, advantage, or solution to occur or to become more pronounced are not to be construed as critical, required, or essential features or components of any or all the claims.

What is claimed is:

1. A breathing apparatus configured to allow a user to breathe underwater, the apparatus comprising:

a rigid outer container comprising a handle, a door mechanism, and a hollow interior space separated into a first compartment and a second compartment; and an interior bag contained within the first compartment and including a first end secured to a mouthpiece and a second end secured to a pump for inflating the interior bag with air;

wherein the mouthpiece extends from the outer container and comprises a valve for drawing air from the interior bag to breathe underwater; and wherein the door mechanism selectively opens to allow a weighted material to be placed in the second compartment for offsetting positive buoyancy created by air within the interior bag when the user is underwater.

2. The breathing apparatus of claim 1, wherein the handle is hollow and the pump includes a portion that extends through the handle.

3. The breathing apparatus of claim 2, wherein the portion of the pump that extends through the handle comprises a plunger having a rod with a stopper attached at one end of the rod and a pull tab attached at a second end of the rod for grasping by a user to inflate the interior bag.

4. The breathing apparatus of claim 1, wherein the interior bag is made of a rubber material.

5. The breathing apparatus of claim 1, wherein the outer container is made of a plastic material.

6. The breathing apparatus of claim 1, further comprising metal weights affixed to an exterior surface of the outer container.

* * * * *